US005738393A

United States Patent [19]

Chao

[11] Patent Number: 5,738,393

[45] Date of Patent: Apr. 14, 1998

[54] AUTOMOTIVE HOOD LATCH HAVING REMOTE ACTUATOR

[75] Inventor: Yi J. Chao, West Bloomfield, Mich.

[73] Assignee: Ford Global Technologies, Inc., Dearborn, Mich.

[21] Appl. No.: 745,231

[22] Filed: Nov. 8, 1996

[51] Int. Cl.[6] ..... E05C 3/26

[52] U.S. Cl. ..... 292/216; 292/26; 292/48; 292/DIG. 14; 292/DIG. 25; 292/DIG. 62

[58] Field of Search ..... 292/216, DIG. 14, 292/DIG. 62, DIG. 43, DIG. 25, 25–30, 45–50, 52, 53, 99, 198, 225, 226, DIG. 72

[56] References Cited

U.S. PATENT DOCUMENTS

| | | | |
|---|---|---|---|
| 2,188,334 | 1/1940 | Claud-Mantle | 292/DIG. 14 |
| 2,256,465 | 9/1941 | Brubaker . | |
| 2,268,741 | 1/1942 | Dall | 292/DIG. 14 |
| 3,905,624 | 9/1975 | Fujita | 292/216 |
| 4,045,064 | 8/1977 | Okada | 292/DIG. 14 |
| 4,875,724 | 10/1989 | Gruber | 292/216 |
| 4,991,884 | 2/1991 | Cairns | 292/DIG. 14 |
| 5,000,493 | 3/1991 | Bastien | 292/DIG. 14 |
| 5,118,146 | 6/1992 | Watanuki | 292/DIG. 62 |
| 5,150,933 | 9/1992 | Myslicki et al. | 292/216 |
| 5,445,421 | 8/1995 | Ferrara | 292/DIG. 14 |
| 5,647,234 | 7/1997 | Foster | 292/DIG. 25 |

FOREIGN PATENT DOCUMENTS

| | | | |
|---|---|---|---|
| 246123 | 7/1963 | Australia | 292/DIG. 14 |
| 247269 | 9/1963 | Australia | 292/DIG. 14 |
| 249884 | 3/1964 | Australia | 292/DIG. 14 |

*Primary Examiner*—Darnell M. Boucher
*Attorney, Agent, or Firm*—Daniel M. Stock; John McRae

[57] ABSTRACT

An automotive hood latch includes a striker carried by the hood latch and two separate latching members carried by the vehicle for alternate engagement with the striker, one of the latching members serving as a safety. The separate latching members are sequentially operated in the unlatching direction by double reciprocation of a remote cable operator. The motorist can release the hood from both latching members without leaving the vehicle.

14 Claims, 6 Drawing Sheets

AUTOMOTIVE HOOD LATCH HAVING REMOTE ACTUATOR

BACKGROUND OF THE INVENTION

1. Field of the Invention

This invention relates to vehicle hood latches, and particularly to a latch construction wherein the primary latching member and the secondary latching member are each remotely operated (e.g. cable operated).

2. Description of Related Prior Art

Conventional vehicle hood latch systems typically include a striker on the hood, a primary latching member on the vehicle body engageable with the striker to hold the hood in the closed position, and a secondary latching member on the vehicle body in the path taken by the striker from the latched condition. The secondary latching member acts as a redundant safety device to prevent the hood from opening in the event that the primary latching member might disengage during service.

Very often the primary latching member is cable-operated from inside the vehicle. The secondary latching member is directly operated (e.g. by a handle). The secondary latching member usually has an actuating handle that is accessible to a person's fingers when the person is standing in front of the vehicle. The actuating handle must be pushed or pulled in a specific direction in order to release the secondary latching member from the striker.

The process of reaching and operating the handle of the secondary latching member may be difficult for some motorists who may not be aware of the handle construction or movement direction required to disengage the secondary latching member from the striker. The process may be more difficult during the nighttime, or when the vehicle is in a dark environment; the operation must then be carried out, using only the sense of feel to find and operate the handle. Also, the process inevitably results in the person's hand becoming dirty from atmosphere dirt accumulation on the vehicle surfaces.

U.S. Pat. No. 2,256,465 to K. Brubaker discloses an automobile latch system wherein the primary and secondary latching members are both operated from within the vehicle via a cable operator. However, the primary latching member is embodied in an over-center linkage that does not provide positive retention of the primary latching member. Under some conditions, e.g. high wind, lift forces on the hood could cause disengagement of the primary latching member.

The present invention relates to a reliable automotive hood latch system wherein both the primary latching member and the secondary latching member are cable-actuated from within the vehicle. The motorist is not required to leave the vehicle and insert his hand into a restricted space at the front edge of the hood in order to disengage the secondary latching member from the striker.

SUMMARY OF THE INVENTION

The invention contemplates an automotive hood latch construction that includes a primary latching member and an auxiliary latching member located within a housing in the path of a striker located on the vehicle hood. A single manually operated control means is provided for opening both latching members; preferably the control means includes a cable operator leading back to the vehicle passenger compartment, whereby the driver of the vehicle can completely release the hood without leaving the vehicle.

The control means and latching members are interconnected so that the primary latching member is disengaged from the striker during a first reciprocation of the cable operator; the secondary latching member is disengaged from the striker during a second reciprocation of the cable operator.

The double reciprocation requirement is a safety feature designed to prevent accidental opening of both latching members by a single inadvertent actuation of the cable operator.

In preferred practice of the invention, the primary latching member includes a hook for holding the striker in the latched position, and a spring means for causing the primary latching member to exert a lifting force on the striker when the hook is withdrawn from the striker.

The primary latching member is normally restrained in the latching position by a lever equipped with a detent. The cable operator can be reciprocated to withdraw the lever from the primary latching member, whereupon the primary latching member applies a lifting force to the striker.

The auxiliary latching member has a lost motion connection to the lever so that during the initial reciprocation of the cable operator, the auxiliary latching member remains in position to intercept the striker and thereby prevent the hood from opening. During a second reciprocation of the cable operator, the lever withdraws the auxiliary latching member from the striker, such that the striker is elevated to a cleared condition under the impetus of the spring-biased primary latching member. The primary latching member serves as a latch and also as a lifter device for the striker.

Further features and details of the invention will be apparent from the attached drawings and description of an illustrative embodiment of the invention.

DESCRIPTION OF PREFERRED EMBODIMENTS

Figure 1:
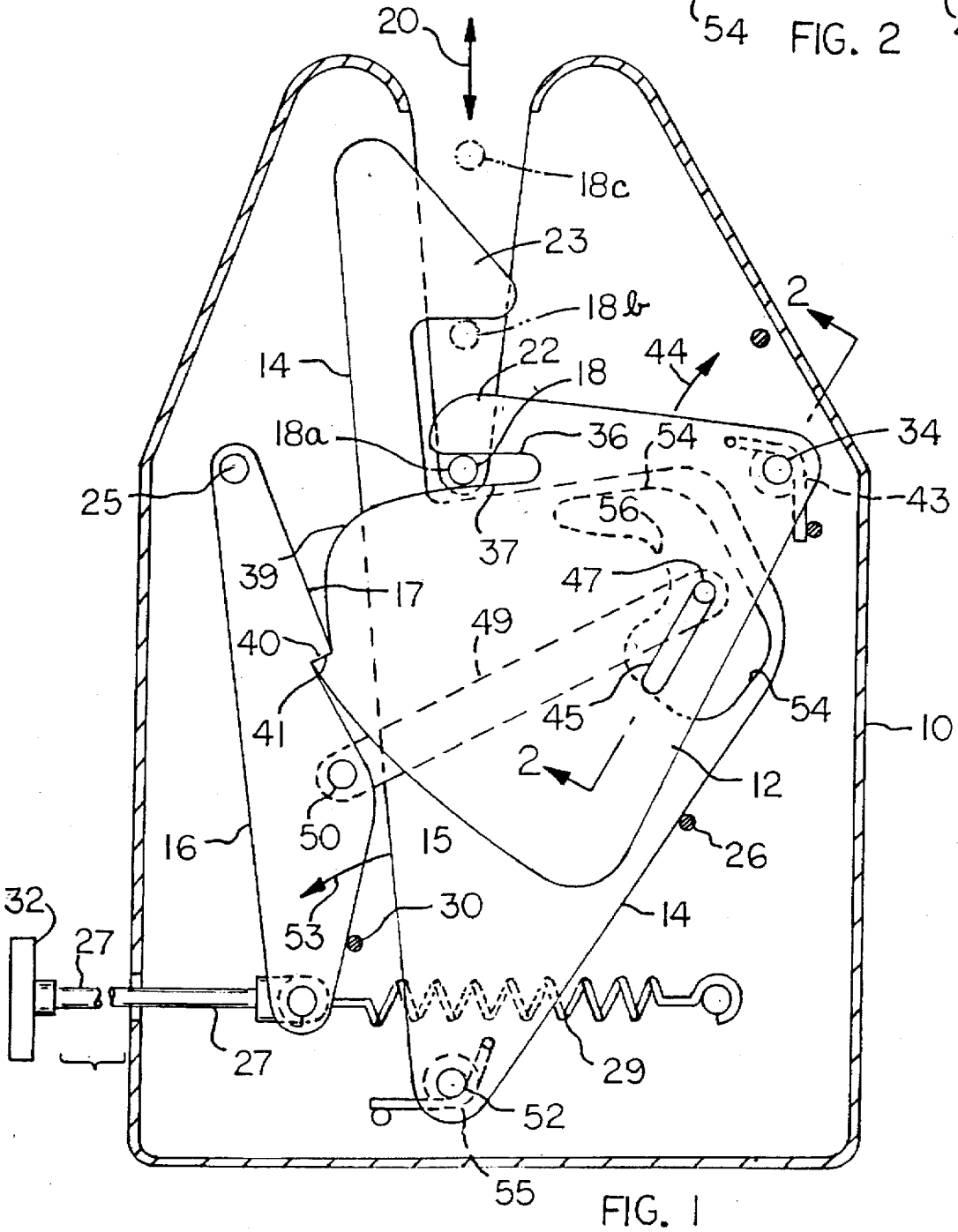
FIG. 1 is an elevational view of a hood latch mechanism embodying the invention. A typical housing for the mechanism is shown in section.

Referring to the FIG. 1, there is shown an automotive hood latch of the present invention, comprising a housing 10 containing a primary latching member 12, secondary latching member 14, and control lever 16. Typically, housing 10 will be mounted on the vehicle body at the upper edge of the front grille so that latching bolt members 12 and 14 are in the path of a striker 18 located on the vehicle front hood.

As shown in the drawing, the striker is a circular rod or bar movable in a generally vertical direction indicated by arrow 20. FIG. 1 shows striker 18 in three different positions: namely, a lowered position 18*a;* an intermediate position 18*b;* and a raised position 18*c*.

In the lowered position 18*a*, the striker is fully latched by primary latch bolt 12, so that the vehicle hood is retained in a fully closed position; hook 22 on the primary latch bolt 12 overlies striker 18 to prevent upward movement of the striker.

In the intermediate position 18*b*, the striker is released from hook 22, but is restrained against upward movement by a second hook 23 on the secondary (auxiliary) latch bolt member 14. Latch member 14 serves as a safety device to prevent the vehicle hood from opening in the event that primary latching member 12 breaks or otherwise fails to operate in the intended fashion.

In the raised position 18*c*, the striker is elevated beyond both latch bolts 12 and 14, such that the vehicle hood is free to be opened, e.g. manually or by some power mechanism.

The two latch members 12 and 14 are controlled and operated by a manual control means that includes a lever 16 having a pivot axis 25, and a cable 27 having one end connected to the lower end of the lever. A tension spring 29 normally holds lever 16 in the FIG. 1 position against a stop 30. Cable 27 extends out of housing 10 and through the engine compartment into the passenger compartment, where it is attached to a handle 32. The handle can be pulled to swing lever 16 away from stop 30, e.g. to the position shown in FIG. 4. When handle 32 is released, spring 29 returns the cable and lever 16 to the FIG. 1 condition.

Referring particularly to primary latch member 12, said member comprises a flat plate having a pivotal connection 34 with housing 10. The plate has a notch 36 extending radially from the pivot axis 34 to form the aforementioned hook 22. Notch 36 has a lower edge surface 37 that merges with an arcuate cam surface 39. This cam surface can exert a lifting action on striker 18 when the latch member rotates in a clockwise direction. In this regard, it will be seen from FIG. 3 that a clockwise rotation of the latch member of about twenty-three degrees (Angle A) lifts striker 18 to the partially unlatched position 18*b*. In the FIG. 3 position the striker is substantially disengaged from latch member 12; i.e., hook 22 no longer restrains the striker from upward movement.

Returning again to FIG. 1, the primary latching plate 12 has an abutment surface 40 contiguous with cam surface 39 and engageable with an overhanging detent surface 41 on lever 16. Lever 16 is a flat plate element coplanar with the primary latching plate 12. In the FIG. 1 condition, the detent surface on lever 16 prevents latching plate 12 from moving upwardly from the FIG. 1 position.

A wire spring 43 encircles the pivot shaft 34 for latching member 12, whereby the latching member is spring-biased in an upward direction, as indicated by arrow 44 in FIG. 1. The latch bolt is potentially in position to exert a lifting force on striker 18, via cam surface 39. Detent surface 41 normally restrains the latching member against upward swinging motion.

Latch bolt plate 12 has a linear slot 45 that accommodates a pin 47 carried by link 49. This link has a pivotal connection 50 with lever 16, such that when the lever swings in a leftward direction (from the FIG. 1 position), the link does not prevent upward swinging motion of latching plate 12. One function of slot 45 is to reset link 49 to the FIG. 1 position when the latch members 12 and 14 are subsequently returned from the FIG. 5 position to the FIG. 1 position (e.g. when the vehicle hood is moved downwardly to the latched condition).

Referring particularly to secondary (auxiliary) latch member 14, said member comprises a flat plate located in a plane parallel to the primary latching plate 12; as viewed in FIG. 1, latching member 14 is located behind plate 12. Latching plate 14 has a pivot connection 52 with the housing, whereby the plate can swing in an arcuate direction as indicated by arrow 53 in FIG. 1. A wire coil spring, encircles the pivot shaft 52 to exert a clockwise biasing force on latching member 14. Latching member 14 is normally spring-biased to the FIG. 1 position against a stop 26. The pivots 25 and 52 for lever 16 and latch bolt 12 are located at approximately the same elevation in housing 10. Also, striker 18 is located on a common horizontal plane with pivots 25 and 34 when the striker is in its lowered position.

Figure 2:
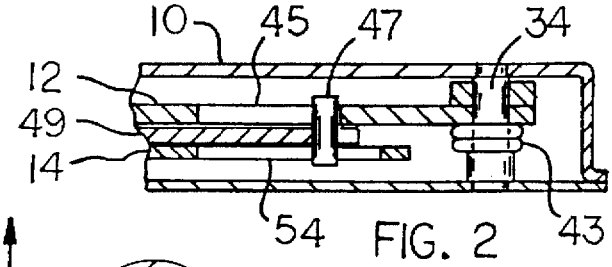
FIG. 2 is a fragmentary sectional view taken on line 2—2 in FIG. 1.

The secondary latching member 14 has a slot 54 that accommodates the aforementioned pin 47. As shown in FIG. 2, link 49 is located in a plane (space) between primary latching plate 12 and secondary latching plate 14; pin 47 extends transversely through link 49 so as to be simultaneously within slot 45 and slot 54. The purpose of slot 54 is to provide a lost motion connection between link 49 and auxiliary latching plate 14, whereby initial reciprocation of lever 16 has no effect on latching plate 14; i.e. plate 14 remains in the FIG. 1 position when latch bolt 12 moves from the FIG. 1 position to the FIG. 3 position. When lever 16 is reciprocated a second time, an edge surface of slot 54 is engaged by pin 47 to move latching plate 14 out of the path of striker 18, thereby releasing the vehicle hood for movement to the open position.

Figure 3:
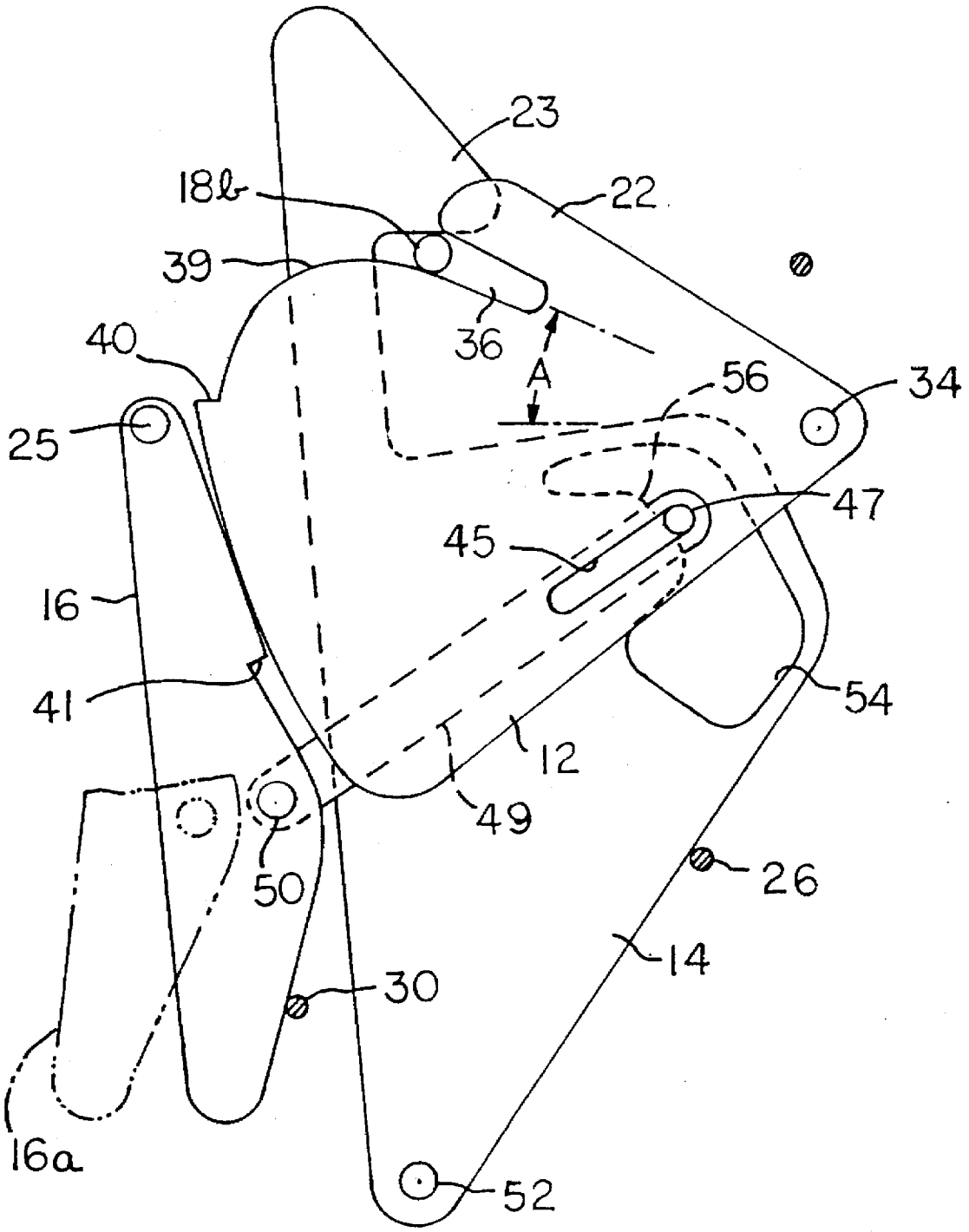
FIG. 3 is a view taken in the same direction as FIG. 1, but showing the mechanism in a partially unlatched condition.
Figure 4:
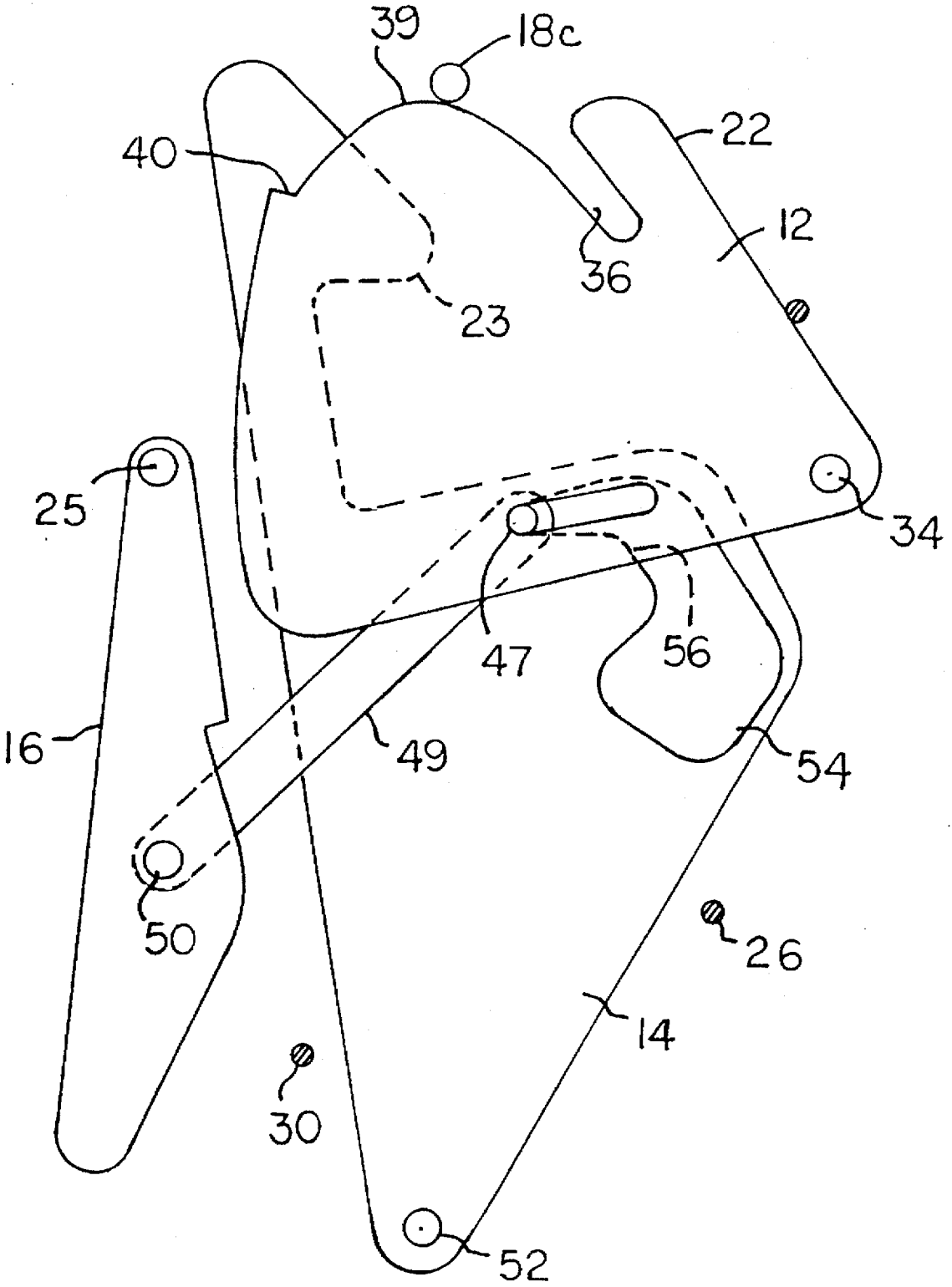
FIG. 4 is a view taken in the same direction as FIG. 1, but showing the mechanism in a fully unlatched condition.
Figure 5:
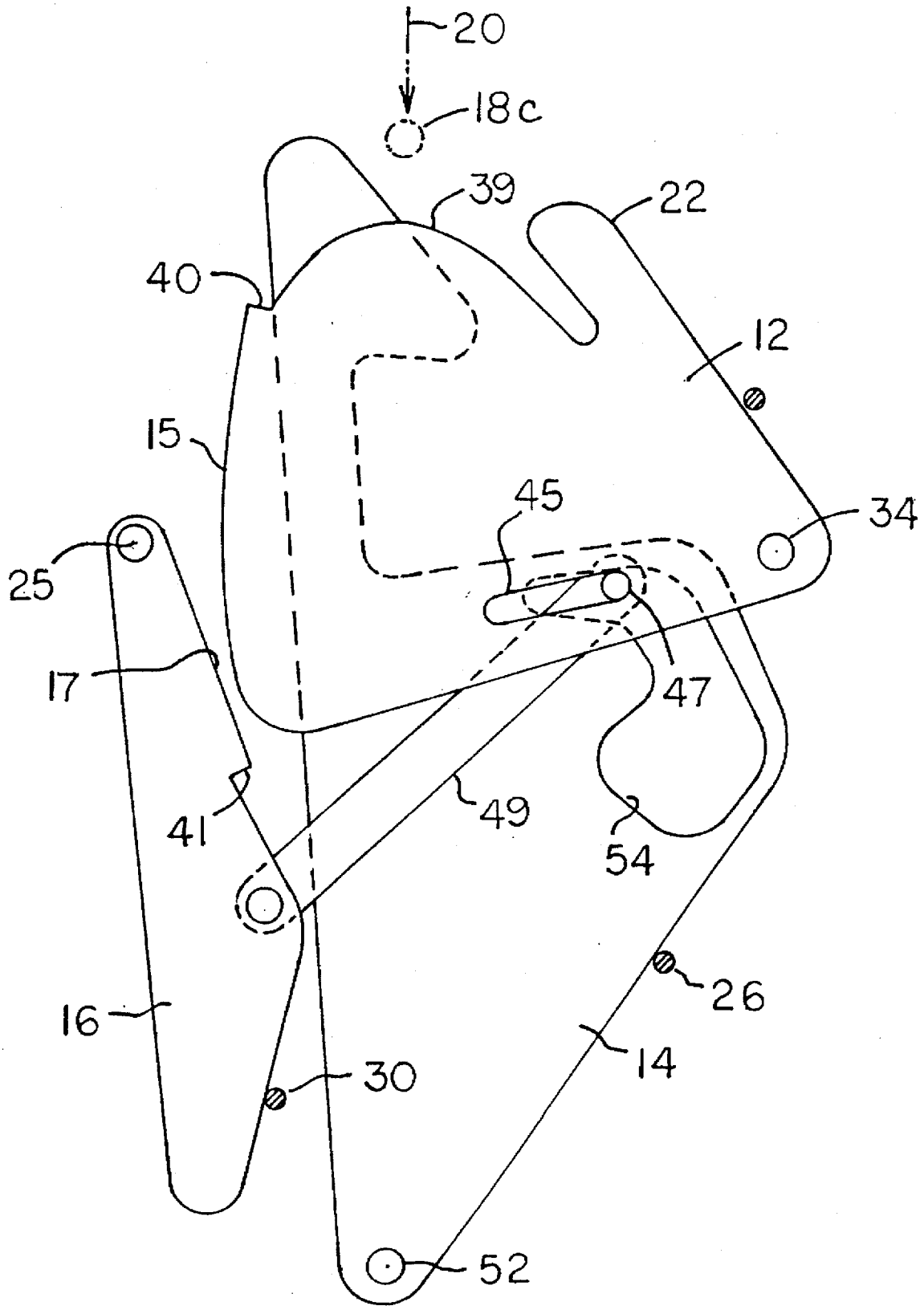
FIG. 5 is a view taken in the same direction as FIG. 4, but with the manual control means returned to a standby inactive condition.

FIGS. 1, 3, 4 and 5 show the latching and control mechanisms in various operating positions. FIG. 1 shows primary latching member 12 in the latched position wherein striker 18 is restrained against upward movement by hook 22. FIG. 3 shows the striker released from primary latching member 12, but restrained by secondary latching member 14; member 12 is spring-biased upwardly to lift striker 18 to the intermediate position 18*b*. FIG. 4 shows striker 18 in its elevated position 18*c*, released from both latch members 12 and 14. FIG. 5 shows lever 16 moved rightwardly against stop 30, whereby the secondary latch member 14 is reset to its normal position engaged with stop 26.

Comparing FIGS. 1 and 3. when a pulling force is applied to handle 32, lever 16 is moved from the FIG. 1 position to the FIG. 3 dashed line position 16*a*. This separates detent 41 from abutment 40, whereupon spring 43 causes latch member 12 to exert a lifting force on striker 18. Striker 18 moves upwardly from position 18*a* to position 18*b*.

Hook 23 prevents the striker from further upward movement. When handle 32 is released, spring 29 returns lever 16 to the full line position (FIG. 3).

When handle 32 is pulled a second time, the latch mechanisms take the positions depicted in FIG. 4. Pin 47 exerts a leftward force on edge surface 56 of slot 54, whereby secondary latch member 14 is swung to the left so that hook 23 moves out of the upward path taken by striker 18. Spring 43 exerts an upward biasing force on primary latch member 12, whereby cam surface 39 exerts a lifting force on striker 18, such that the striker is raised to the elevated position 18*c*.

When handle 32 is released, spring 29 returns lever 16 to the FIG. 5 position, wherein the mechanism is reset for the next latching cycle. FIG. 5 represents the released position wherein the vehicle hood is open, or at least in condition to be opened without interference by the latch mechanism. It should be noted that two reciprocations of the manual control means 32, 37, 16 are required to go from the FIG. 1 latched condition to the FIG. 5 released condition. During the first reciprocation of cable operator 27, striker 18 moves from the FIG. 1 latched condition to the FIG. 3 partially latched condition. During the second reciprocation of cable operator 27, striker 18 moves from the intermediate (partially latched) condition **18*b* to the FIG. 5 elevated condition 18*c*** (fully released).

During the next latching cycle, the striker moves downwardly along path 20 to swing primary latching member 12 counterclockwise around pivot 34; secondary latch member 14 is momentarily deflected and then returned to the FIG. 1 position under the impetus of spring 55. Also, abutment 40 on latching member 12 snaps into engagement with detent surface 41 on lever 16; the lever may momentarily deflect away from stop 30 as edge surface 15 of latching member 12 rides along the lever edge surface 17.

Slot 54 is configured to provide adequate clearance for pin 47 during the reset period, i.e. from the FIG. 5 position to the FIG. 1 position. An important feature of the invention is that the complete cycle is accomplished by a double reciprocation of the manual control means 32, 27, 16. Both latch members 12 and 14 are operated remotely from within the passenger compartment. It is not necessary for the motorist to leave the vehicle and manually contact either latch member directly.

Figure 6:
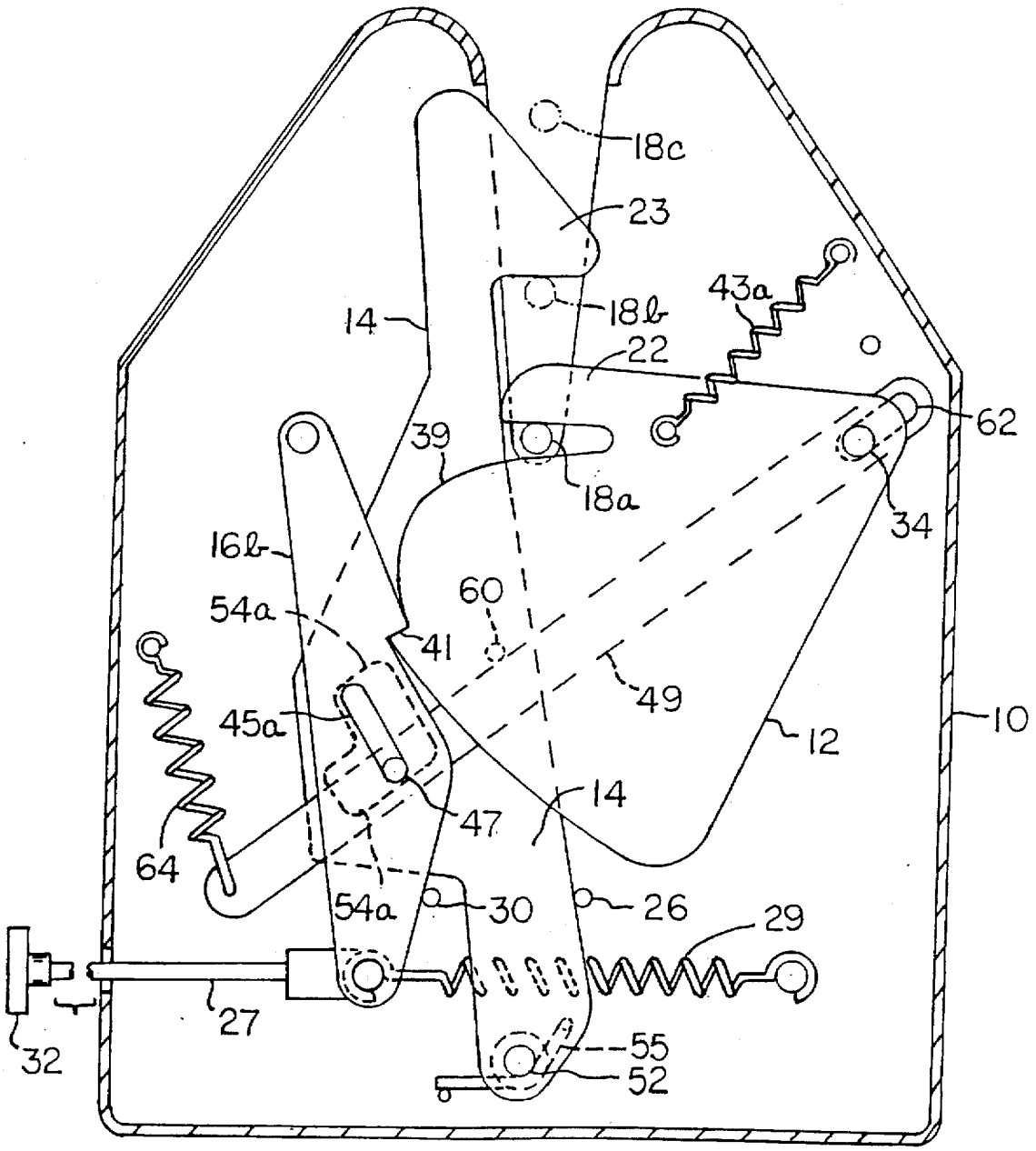
FIG. 6 is a view taken in the same direction as FIG. 1, but showing another form that the invention can take.
Figure 7:
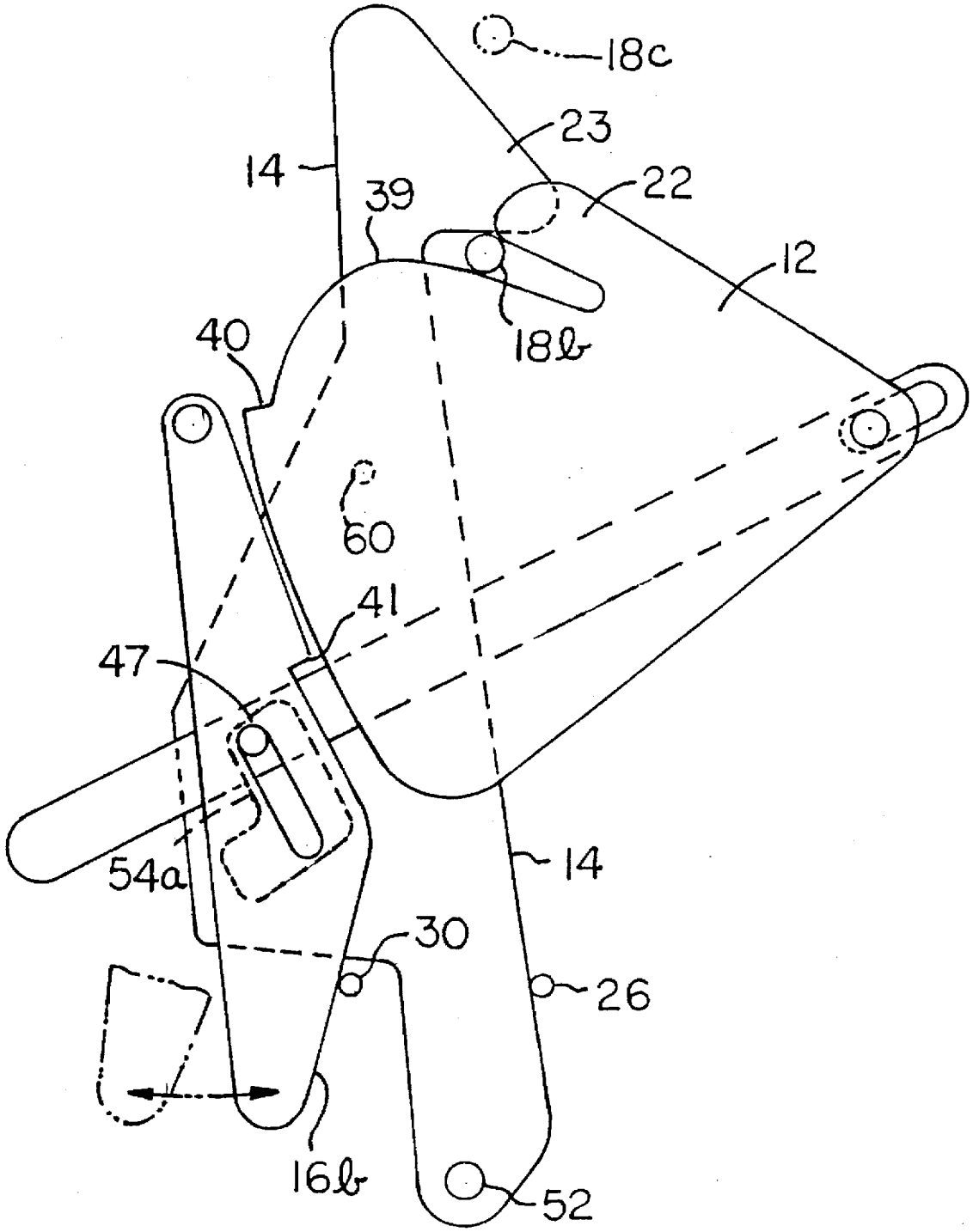
FIG. 7 is a view of the FIG. 6 latch mechanism taken in a partially unlatched condition.

Some variations in construction and arrangement may be used while still practicing the invention. FIGS. 6 and 7 show one alternative arrangement that can be used. FIG. 1 represents the preferred embodiment. FIG. 6 is the less preferred form of the invention.

Referring to FIG. 6, primary latching member 12 is similar to the corresponding FIG. 1 latching member except that it has no linear slot (i.e. slot 45). Latching member 12 has a pin 60 engaged against link 49 when member 12 is in the FIG. 6 latched position.

Lever **16*b* has a linear slot 45*a* that performs essentially the same function as slot 45 in the FIG. 1** embodiment; the linear slot is formed in the lever rather than in the link.

Link 49 is a flat plate element positioned between primary latching member 12 and secondary latching member 14. The link has a transverse pin 47 extending within slot 45 in lever **16*b* and slot 54*a* in the secondary latching member 14. Slot 54*a* serves the same function as slot 54 in the FIG. 1 embodiment. The right end portion of link 49 has a linear slot 62 encircling the fixed pivot shaft for latching member 12. Slot 62 serves as a mechanism for allowing link 49 to pivot and also slide in the longitudinal direction (i.e. in the length dimension of the link). The left end of link 49 is connected to a tension spring 64 that is suitably anchored to the latch housing. Aforementioned pin 60 engages link 49 to prevent spring 64 from swinging the link upwardly when latching member 12 is in the FIG. 6** position.

Secondary latching member 14 has a fixed pivot shaft 52 and a coil spring 55 for biasing the latching member clockwise into engagement with stop 26. As previously noted, latching member 14 has a slot **54*a* engaged with transverse pin 47 carried by link 49**.

FIG. 7 shows the FIG. 6 latching mechanism in the partially unlatched condition wherein striker 18 is lifted to the intermediate position **18*b*, substantially disengaged from hook 22 on the primary latching member 12. The FIG. 7 condition is achieved by a first reciprocation of cable operator 27, such that lever 16*b* is swung to the dashed line position (FIG. 7) and then returned to the initial position against stop 30. When lever 16*b* moves to the dashed line position, detent surface 41 on the lever moves out of the path of abutment 40, such that tension spring 43*a* is enabled to exert an upward lifting force on latching member 12. Cam surface 39 exerts a lift force on striker 18, whereby the striker is moved upwardly until it comes in contact with hook 23 on the secondary latching member 14**.

A second reciprocation of cable operator 27 causes lever **16*b* to swing back and forth in the previously described fashion. As the lever swings leftwardly from the FIG. 7 position (to the dashed line position), pin 47 exerts a leftward force against an edge of slot 54*a*, whereby the secondary latching member 14 is moved out of the path of striker 18. Tension spring 43*a* moves latching member 12 upwardly so that cam surface 39 lifts the striker 18 to the raised position 18*c***.

When spring 29 returns lever **16*a* to its normal position (contacting stop 30), the two latching members 12 and 14 will be in the positions similar to the positions depicted in FIG. 5; the striker is then fully released from the two latching members 12 and It will be seen that the FIG. 6 construction operates in the same fashion as the FIG. 1** construction. In both cases the striker is released from the primary and secondary latching members by a double reciprocation of the cable operator. A principal feature of the invention is that both latching members are operated remotely from the passenger compartment. The motorist does not have to leave the vehicle in order to release the vehicle hood for hood-operating purposes.

In both illustrated forms of the invention, the primary latch bolt 12 is retained in the latching position by engagement of detent surface 41 against abutment Detent lever 16 (or **16*b*) is held in the operating position (FIG. 1 or FIG. 6) by a spring 29, such that latch bolt 12** is securely held in the latching position. The lever-latch bolt relationship depicted herein is believed to have a more secure locking action than the primary latch member used in aforementioned U.S. Pat. No. 2,256,465.

I claim:

1. An automotive hood latch, comprising:

a movable striker having a lowered fully latched position, an intermediate partially latched position, and a raised unlatched position;

a primary latching member adapted to hold said striker in its lowered position; spring means continually exerting a lifting force on said primary latching member;

a secondary latching member adapted to hold said striker in its intermediate position; and a remotely-operated control means for said latching members; said control means comprising a cable operator and a reciprocatable detent mechanism connected thereto; said detent mechanism having a fixed length stroke between an operating position and a retracted position;

said detent mechanism having a disengageable detent connection with said primary latching member and a cam and slot means provided on said secondary latching member for providing a lost motion drive connection with said secondary latching member, whereby during a first reciprocation of said cable operator, the primary latching member is released from said detent mechanism to lift the striker from its lowered position to its intermediate position; and during a second reciprocation of said cable operator, the secondary latching member is disengaged from said striker to enable said primary latching member to lift the striker to its raised position.

2. The hood latch of claim 1, wherein said primary latching member has a cam surface engageable with said striker to lift the striker from its lowered position to its raised position under the impetus of said spring means.

3. The hood latch of claim 1, wherein said detent mechanism comprises a lever pivotable around a first fixed axis, said primary latching member being swingable around a second fixed axis, said secondary latching member being swingable around a third fixed axis.

4. The hood latch of claim 3, wherein said detent lever has a detent surface, and said primary latching member has an abutment engageable with said detent surface when said striker is in its lowered position.

5. The hood latch of claim 1, wherein said lost motion connection comprises a link connected between said detent mechanism and said secondary latching member, said secondary latching member having a cam slot therein, said link having a cam movable within the cam slot, whereby during a first reciprocation of said cable operator the cam moves freely within the cam slot, and during a second reciprocation of said cable operator the cam exerts a force on the cam slot surface.

6. The hood latch of claim 1, wherein said detent mechanism comprises a lever pivotable around a fixed axis, said lost motion connection comprising a link connected between said lever and said secondary latching member, said secondary latching member having a cam slot therein, said link having a cam movable within the cam slot, whereby during a first reciprocation of said cable operator the cam moves freely within the cam slot, and during a second reciprocation of said cable operator the cam exerts a force on the cam slot surface.

7. The hood latch of claim 6, wherein said link has a pivot connection with said lever and a pin-slot connection with said primary latching member.

8. The hood latch of claim 6, wherein said link has a pin-slot connection with said lever and a fixed slidable pivot mounting remote from said lever.

9. The hood latch of claim 1, wherein said detent mechanism comprises a lever pivotable around a first fixed axis, said primary latching member being swingable around a second fixed axis, said secondary latching member being swingable around a third fixed axis, said first and second pivot axes having approximately the same elevation, said third pivot axis being located an appreciable distance below said first and second pivot axes.

10. An automotive hood latch, comprising:

a movable striker having a lowered fully latched position, an intermediate partially latched position, and a raised unlatched position, a primary latching plate adapted to hold said striker in its lowered position; spring means continually exerting a lifting force on said primary latching plate;

a secondary latching plate adapted to hold said striker in its intermediate position; and a remotely-operated control means for said latching plates; said control means comprising a cable operator and a reciprocatory detent mechanism connected thereto; said detent mechanism having a fixed length stroke between an operating position and a retracted position;

said detent mechanism comprising a lever pivotable around a first fixed axis; said primary latching plate being swingable around a second axis;

said detent lever having a detent surface, and said primary latching plate having an abutment engageable with said detent surface only when said striker is in its lowered position;

said detent lever having a lost motion connection with said secondary latching plate; said lost motion connection comprising a cam slot in said secondary latching plate, and a link connected to said detent lever; said link having a cam movable within the cam slot, whereby during a first reciprocation of said cable operator, the primary latching plate is released from said detent lever to lift the striker from its lowered position to its intermediate position, and during a second reciprocation of said cable operator, the link disengages said secondary latching plate from the striker, thereby enabling said primary latching plate to lift the striker to its raised position.

11. The hood latch of claim 10, wherein said link has a pivotal connection to said lever.

12. The hood latch of claim 10, wherein said link has a pin-slot connection to said lever.

13. The hood latch of claim 10, and further comprising a second cam slot in said primary latching plate, and a second cam carried by said link in said second slot; said second cam slot being configured so that said first mentioned cam changes its orientation relative to the first mentioned cam slot during the first reciprocation of the cable operator.

14. The hood latch of claim 10, and further comprising a second cam slot in said detent lever, and a second cam carried by said link in said second slot; said second cam slot being configured so that said first mentioned cam changes its orientation relative to the first mentioned cam slot during the first reciprocation of the cable operator.

* * * * *